US006986177B2

(12) United States Patent
Thaxton

(10) Patent No.: US 6,986,177 B2
(45) Date of Patent: Jan. 17, 2006

(54) APPARATUS AND SYSTEM FOR SUPPORTING AN INDIVIDUAL DURING REPOSITIONING

(76) Inventor: Bart J. Thaxton, 11864 S. 1900 West, Riverton, UT (US) 84065

( * ) Notice: Subject to any disclaimer, the term of this patent is extended or adjusted under 35 U.S.C. 154(b) by 0 days.

(21) Appl. No.: 10/909,763

(22) Filed: Aug. 2, 2004

(65) Prior Publication Data

US 2005/0022301 A1 Feb. 3, 2005

Related U.S. Application Data

(60) Provisional application No. 60/491,387, filed on Jul. 31, 2003.

(51) Int. Cl.
*A61G 7/10* (2006.01)
*A47K 17/02* (2006.01)
*A47F 5/08* (2006.01)

(52) U.S. Cl. ..... 5/81.1 R; 5/662; 16/436; 211/99; 211/119.009; 248/291.1

(58) Field of Classification Search ..... 5/81.1 R, 5/622; 211/99, 119.009, 32, 87.01, 16; 16/436, 16/438; 248/311.2, 291.1
See application file for complete search history.

(56) References Cited

U.S. PATENT DOCUMENTS

| | | | | | |
|---|---|---|---|---|---|
| 649,901 | A | | 5/1900 | Brennan | |
| 1,582,487 | A | * | 4/1926 | Shank | 482/130 |
| 1,667,657 | A | * | 4/1928 | Dobert | 211/99 |
| 2,059,171 | A | * | 10/1936 | Harris | 4/576.1 |
| 2,200,411 | A | * | 5/1940 | Boye | 248/265 |
| 2,576,873 | A | * | 11/1951 | Zelov | 211/88.04 |
| 2,640,594 | A | * | 6/1953 | Lesikar | 211/32 |
| 3,310,817 | A | | 3/1967 | Harding | 5/92 |
| 4,908,906 | A | * | 3/1990 | Hanna | 16/445 |
| 5,098,108 | A | * | 3/1992 | McKinney | 273/400 |
| 5,235,711 | A | | 8/1993 | Jandrakovic | 5/81.1 |
| 5,384,927 | A | | 1/1995 | Mardero et al. | 5/662 |
| 5,590,440 | A | * | 1/1997 | Pelt et al. | 16/429 |
| 5,787,515 | A | | 8/1998 | Mason et al. | 4/254 |
| 6,012,182 | A | | 1/2000 | Allen et al. | 5/81.1 |
| 6,068,225 | A | | 5/2000 | O'Brian et al. | 248/200.1 |
| 6,131,213 | A | * | 10/2000 | Sarff | 4/576.1 |
| 6,213,435 | B1 | | 4/2001 | Minet | 248/125.8 |

(Continued)

OTHER PUBLICATIONS

"Health Craft", www.healthcraftkproducts.com.

*Primary Examiner*—Alexander Grosz
(74) *Attorney, Agent, or Firm*—Kunzler & Associates

(57) ABSTRACT

An apparatus and system are disclosed for supporting an individual during repositioning. A handle permits a user facing a first direction to traverse the perimeter of the handle to face a second direction. Thus, the user moves from a first position to a second position while maintaining contact with the handle with at least one hand. The handle has an arcuate portion that permits a user to slide one or two hands such that the user pivots about the arcuate portion to face another direction while retaining a grip. The apparatus may further include a base coupled to the handle that supports the user during movement around the arcuate portion. A hinge connects the handle to the base and permits the handle to rotate between a storage position and a support position. A bar mounted to the base enables lateral slidable adjustment of the handle along the bar.

13 Claims, 7 Drawing Sheets

U.S. PATENT DOCUMENTS 6,230,339 B1 * 5/2001 McCrink ..... 4/576.1
6,276,027 B1 * 8/2001 Hanna ..... 16/436
6,557,189 B2 5/2003 Von Schroeter ..... 5/86.1
6,560,794 B2 5/2003 Allen et al. ..... 5/81.1
6,845,870 B2 * 1/2005 Yang ..... 211/99
2002/0133878 A1 9/2002 O'Connell ..... 5/81.1

* cited by examiner

APPARATUS AND SYSTEM FOR SUPPORTING AN INDIVIDUAL DURING REPOSITIONING

CROSS-REFERENCES TO RELATED APPLICATIONS

This application claims benefit of U.S. Provisional Patent Application No. 60/491,387 entitled "SYSTEM, METHOD, AND APPARATUS FOR SUPPORTING AN INDIVIDUAL DURING REPOSITIONING" and filed on Jul. 31, 2003 for Bart J. Thaxton, which is incorporated herein by reference.

BACKGROUND OF THE INVENTION

1. Field of the Invention

This invention relates to support devices and more particularly relates to systems, methods, and apparatus for supporting an individual during repositioning.

2. Description of the Related Art

For years many have tried to alleviate the physical hardships associated with age, disabilities, and infirmities by providing equipment to assist individuals of limited capacity to stand, to support their own weight, to change locations, and to sit down safely. Currently available support devices, however, often contain ropes, chains, pulleys, swinging gates, and/or complicated assemblies that may be unstable and may cause a user to feel insecure, scared or confused. In addition, the support devices may be limited in their application: the devices may be immobile and nonadjustable, may fail to completely support the weight of an individual, may restrict a user's range of uses, may require significant upper body strength, may support only an isolated movement or range of motion, and/or may require assistance from another person. Furthermore, the available devices may fail to support an individual while changing from one position to another.

Many rise assists offer support to an individual as they transition from a seated position, such as on a bed, to a standing position. However, the user typically must let go of the rise assist to reorient their position, such as to sit in a wheel chair. The assists generally do not provide continual support as the user transitions from a first position to a second position. The lack of constant support can cause an individual to panic or to lose their stability during repositioning. In addition, currently available rise assists fail to support the individual if the user's upper body strength fails during repositioning or if the user begins to fall.

From the foregoing discussion, it should be apparent that a need exists for an apparatus and system that fully and continually supports a user during repositioning. Beneficially, such an apparatus and system would provide a user with a handle that supports the user and permits the user to move around the handle, or change positions, without completely letting go of the handle. Additionally, the apparatus and system would support the individual without requiring significant upper body strength and would provide support to the user's upper body to prevent the user from falling.

SUMMARY OF THE INVENTION

The present invention has been developed in response to the present state of the art, and in particular, in response to the problems and needs in the art that have not yet been fully solved by currently available rise assists. Accordingly, the present invention has been developed to provide an apparatus and system for supporting an individual that overcome many or all of the above-discussed shortcomings in the art.

The present invention provides an apparatus for supporting an individual that is sturdy, simple, mobile and adjustable. The system and design of the present invention sufficiently supports an individual while changing positions in various situations and maybe used by an individual with minimal or no assistance. The apparatus may support the upper body of an individual without requiring significant upper body strength.

The apparatus, in one embodiment, is configured to provide a support device that supports an individual moving from a first position to a second position. The support device includes a handle that permits a user facing a first direction to traverse the perimeter of the handle to face a second direction. The user may move around the handle without losing support. Preferably, the user can traverse the perimeter of the handle and maintain a grasp of the handle with at least one hand. Thus, the user can confidently use the support device without fear of falling during the transition from facing one direction to facing another. In one embodiment, the handle has a curvature that permits a user facing a first direction to traverse up to about 270 degrees of the perimeter of the handle to face a second direction. The handle, in one embodiment, comprises a closed, circular bar.

The apparatus is further configured, in one embodiment, to include a base. The base may position the handle at about waist level for the user such that the user can readily rest the upper body on the handle. Consequently, the user may lean their body against the handle for additional support. In one embodiment, the handle is positioned in a substantially horizontal support position. The support device may include an adjustable fastener or hinge to enable the user to adjust the orientation of the handle relative to the base.

In certain embodiments, the base comprises a telescoping horizontal member that allows the user to adjust the handle laterally. One or more extensions maybe attached to the telescoping horizontal member to provide additional support to the base. In one embodiment, a fastener securely connects the base to a support.

In a further embodiment, the apparatus may be configured to include a telescoping vertical member. The telescoping vertical member may connect the handle to the base such that adjusting the height of the vertical member changes the height of the handle. The telescoping vertical member may include an inner wall, an outer wall to receive the inner wall, and a securing mechanism to secure the inner wall with respect to the outer wall. A drive member may be connected to the vertical telescoping member to extend and retract the telescoping member.

A securing mechanism may include a hollow inner wall that inserts into an outer wall, a pair of stops to engage the inner wall, and a center wedge between the stops that preferably comprises a threaded hole. The threaded hole may receive a threaded shaft such that rotation of the shaft in one direction drives the wedge between the stops. One or more studs may be attached to at least one stop. The stud may engage the outer wall through an opening in the inner wall. The securing mechanism secures an extended telescoping member.

A system of the present invention is also presented to support an individual. The system may be embodied in a support device that includes a handle, a base, a telescoping vertical member, and a drive member. In particular, the system, in one embodiment, includes a handle that permits a user facing a first direction to traverse the perimeter of the handle to face a second direction. The base securely supports the handle and the user during movement around the handle. The telescoping vertical member connects the base to the handle and enables the user to adjust the height of the handle. The drive member may comprise a hydraulic cylinder to extend and retract the telescoping vertical member.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
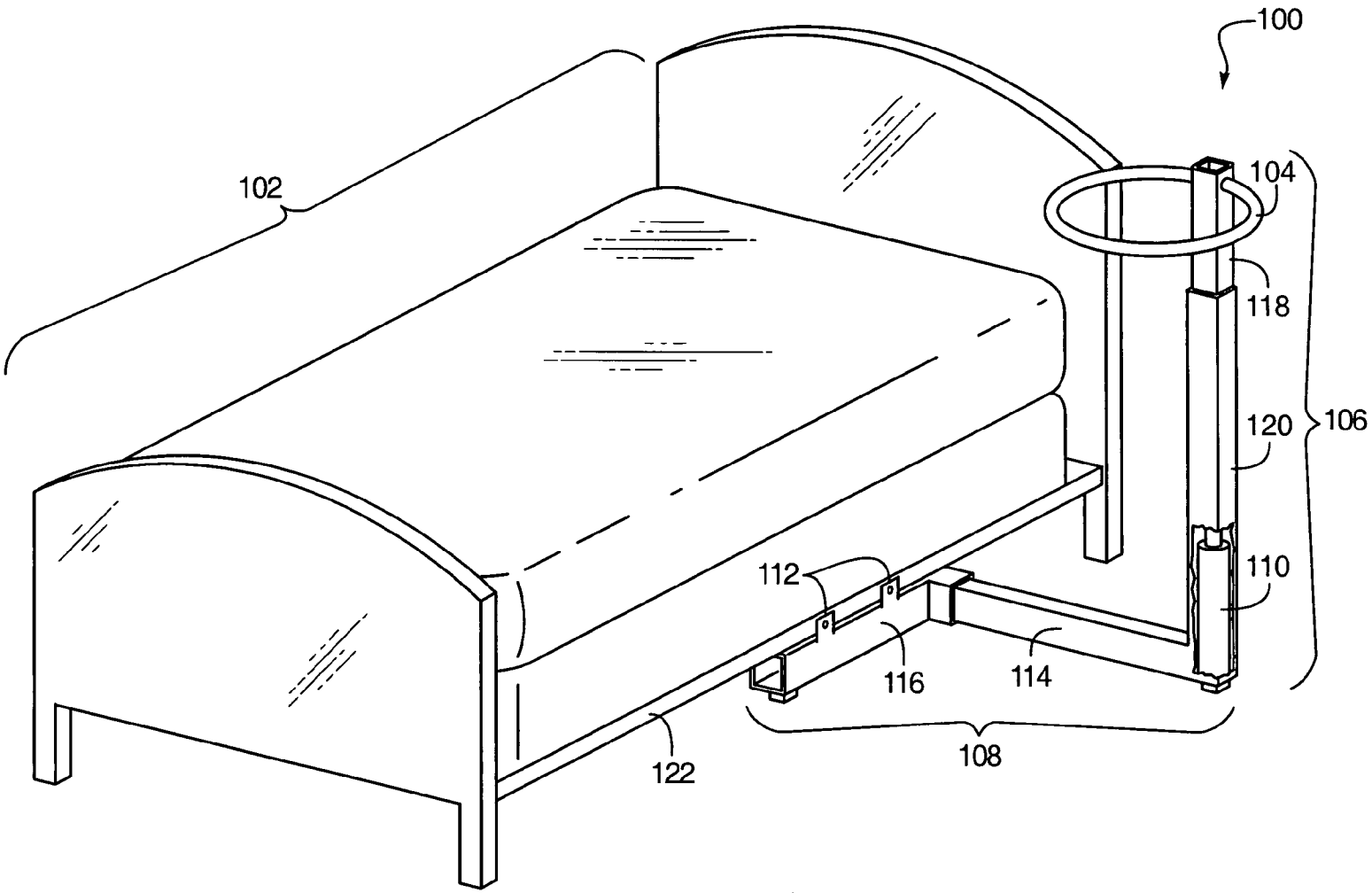
FIG. 1 is a perspective view illustrating one embodiment of a support device fastened to a bed in accordance with the present invention.

FIG. 1 depicts one embodiment of a support device 100 of the present invention fastened to a support such as a bed 102. The support device 100, as depicted, comprises a handle 104, a telescoping vertical member 106, a base 108, a drive member 110, and fasteners 112. The base 108 includes a telescoping horizontal member 114 and an extension 116. The support device 100 provides support to a user such that a user may confidently transition from a first position to a second position without losing contact or grip with the handle 104.

The handle 104 may be circular or polygonal shaped to support a user as they traverse the perimeter of the handle 104. The shape of the handle 104 preferably allows an individual to pull their body from a supine and/or seated position and then provides continued support once the user is standing, or vice versa. The user may then rely on the support device 100 for support as the user changes directions to enter a second position. If additional support is required during the transition, the user may rest their entire body against the handle 104 while grasping a different part of the handle 104 with one or both hands if desired. In certain embodiments, a closed handle 104 permits a user to move about within arm's reach of the support device 100 without losing support. The user may also traverse nearly the entire circumference of the handle 104 with support to achieve a desired position, because the handle 104 is positioned such that the surrounding space is free of bars, chains, corners, or similar interferences. In one embodiment, the handle has a curvature that permits a user facing a first direction to traverse up to about 270 degrees of the perimeter of the handle to face a second direction. In certain embodiments, the handle 104 maybe located at about waist level of the user.

In a preferred embodiment, the handle 104 is circular or arcuate to eliminate protruding corners. The arcuate shape enables the user to continuously slide hands around the handle 104 without completely releasing the grip. A circular handle 104 also enables the user to comfortably traverse the circumference of the handle 104 at various degrees. For example, a user may slowly change position or direction one degree at a time, if desired, until the final resting position is achieved.

Those of skill in the art will recognize that the handle 104 may be configured in various shapes and forms, including, but not limited to, open or closed polygonal shapes. In one embodiment, the handle 104 is made of stainless steel and has a circular shape. The handle 104, however, may be made of any suitable material, including wood, plastic, aluminum, and the like, and may include a covering such as foam, leather, or synthetic materials to enhance the gripping qualities and/or aesthetic qualities of the handle 104.

The support device 100 may further include a telescoping vertical member 106 configured to adjust the height of the handle 104 according to the needs of the user. Because the position of the handle 104 may be customized, the support device 100 may be used in numerous applications and by various users. For example, a handle 104 may be positioned higher to support a user pulling him/herself up from a bed and positioned lower to assist a user transferring from a sofa to a wheel chair. In addition, the device 100 may be adjusted to suit the height and weight of an individual. Thus, multiple users may benefit from a single support device 100.

In certain embodiments, the telescoping vertical member 106 comprises an inner wall 118 and an outer wall 120. The handle 104 may be connected to the inner wall 118. In one embodiment, the handle 104 is welded to the inner wall 118. In the depicted embodiment, the telescoping vertical member 106 is adjusted by a drive mechanism 110 that extends and retracts the inner wall 118 with respect to the outer wall 120. A drive mechanism 110 may include a hydraulic cylinder, an electrically powered motor, or the like. Alternatively, an individual may manually adjust the height of the telescoping vertical member 106 as will be discussed in relation to FIG. 2.

The drive mechanism 110 may be any system suitable for adjusting the height of the telescoping vertical member 106. In certain embodiments, an automated, height-adjustment system is controlled remotely. A remote controlled automated system permits a user to adjust the support device 100 according to personal needs without requiring the assistance of another person.

In certain embodiments, the telescoping vertical member 106 connects to an adjustable base 108. The base 108 of the present invention may have a variety of forms and functions to meet the needs of the user. In certain embodiments, for instance, the base 108 may be adjustable to position the handle 104 in close proximity to a user, bed 102 or other device. As shown in FIG. 1, the base 108 may comprise a telescoping horizontal member 114 to adjust the vertical position of the handle 104. Similar to the height-adjusting system mentioned earlier, the base 108 may include an automated adjustment system that may be controlled remotely.

Adjustable apparatus, especially apparatus configured with an automated system, allow a user to quickly change the vertical and horizontal position of a handle 104 to provide the best possible support for an individual at any particular moment. Thus, the user may be confident that the support device 100 adequately supports a particular individual, because the apparatus may be customized to their needs and various positions. Nevertheless, a stationary support device 100 without telescoping members 106, 114 is within the scope of certain embodiments of the invention.

In the depicted embodiment, the base 108 further includes an extension 116 that affords additional support to stabilize the support device 100. In certain embodiments, the extension 116 comprises a hollow metal beam perpendicularly coupled to a telescoping horizontal member 114. In alternative embodiments, an extension 116 may acutely protrude from the horizontal member 114 forming a "Y" shape or other shape to provide more room for movement of the user. The horizontal telescoping member 114 may also be configured to provide additional space for the user. The base 108 of the support device 100 may have many forms. In certain embodiments, the base 108 may include a plurality of extensions 116. Further still, the base 108 may comprise circular extensions 116. Also, based on the need for the support device 100, the base 108 may have extensions 116 of varying lengths and sizes.

Certain embodiments of the base 108 may be configured to securely attach the support device 100 to the frame 122 of a bed 102, the floor, or other support, to provide a more stable support system. The base 108 in the depicted embodiment includes a plurality of fasteners 112 to secure the support device 100 to the bed 102. The fasteners 112 may comprise a latch, clamp, cam lock or the like. In a preferred embodiment, the fastener 112 comprises a clevis attachment welded to the extension 116. The open end of the clevis may then be bolted or fastened to the frame 122 to prevent movement of the base 108. One or more fasteners 112 may be attached to various components of the base 108.

In the depicted embodiment, the base 108 is designed to fit under a typical bed 102, thereby placing the handle 104 in a suitable position to assist a user in climbing into and out of the bed 102. The configuration of the base 108, however, and the use of fasteners 112 may be selected to function with various types of beds 102, bed frames 122, or other support structures as desired.

As depicted, the telescoping vertical member 106 and the telescoping horizontal member 114 may be extended or retracted in order to position the handle 104 according to the desires of an individual. For example, an individual lying on a bed 102 may decrease the length of the telescoping horizontal member 114 to position the handle 102 in close proximity to the bed 102. Then by decreasing or increasing the height of the telescoping vertical member 104, the user may bring the handle 104 into a convenient position to pull him/herself into a sitting position on the bed 102. If, for instance, the user wishes to move from the bed 102 to a wheel chair, the user may then choose to readjust the position of the handle 104. The user may then grip the handle 104 to rise to a standing position, use the handle 104 to regain their balance, move their body around the handle 104 to a desired direction or location, and then use the handle 104 for support while sitting down in the wheel chair. If perhaps, more support is needed, the individual may rest their body against the handle 104 until they are ready to sit down safely in the wheel chair.

The support device 100 supports the user throughout the entire process without requiring the user to release the handle 104. Consequently, the user may change positions without being afraid of losing their balance. The shape of the handle 104 provides continuous support as a user moves from one location or direction to another, such as from a couch to a handrail, from a bed to a chair, or from a bed to a dresser, etc. Hence, the support device 100 may be used to support an individual in many situations; for example, while moving to or from an automobile, bathtub, sofa, toilet, or any other appropriate application.

Figure 2:
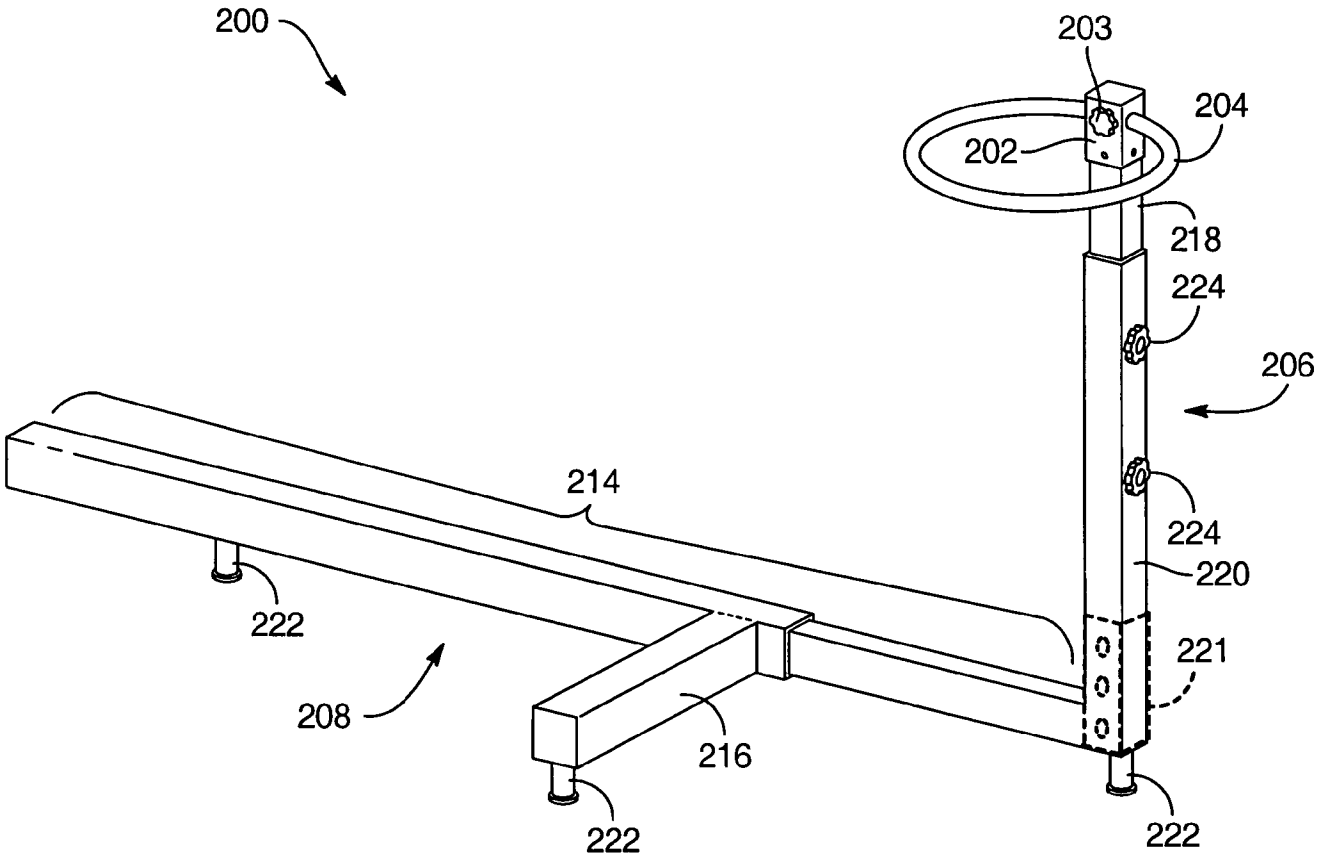
FIG. 2 is a perspective view illustrating an alternative embodiment of a support device in accordance with the present invention.

FIG. 2 illustrates an alternative embodiment of a support device 200. The support device 200 includes a coupling 202, an adjustable fastener 203, a handle 204, a telescoping vertical member 206, a base 208, feet 222, and securing mechanisms 224. The support device 200 is simple and may be manually adjusted.

The handle 204 allows an individual to grip the supporting device 200. The handle 204 may be connected to the telescoping vertical member 206 by a coupling 202 configured to allow replacement of one handle 204 with a different handle 204. In one embodiment, the handle 204 may be interchangeable, allowing a user to select the size and shape of a handle 204 for a particular application. In addition, the coupling 202 may allow the user to secure the handle 204 in a selected direction, for example, facing parallel to a bed 102 (FIG. 1) or facing perpendicular to the bed 102. In certain embodiments, the angle of the handle 204 may also be adjustable according to the desires of an individual. The handle may include an adjustable fastener 203 to adjust the angle of the handle 204 with respect to the floor. In one embodiment, a hand knob enables or restricts movement of the handle 204 as necessary for adjustment.

Similarly, the securing mechanism 224 may comprise a hand knob with a threaded post that can be screwed into tapped holes in the inner wall 218. In certain embodiments, the outer wall 220 may include slots (not shown) on the side to receive the hand knob or securing mechanism 224. The slots enable the inner wall 218 to be adjusted with respect to the outer wall 220 and then secured with the securing mechanism 224. Alternatively, a securing mechanism 224, such as a pin, bolt, or other fastener, may be inserted through aligned holes in the inner wall 218 and outer wall 220. In a further embodiment, a securing member 224, such as a spring pin, may be attached to the inner wall 218 to releasably secure the telescoping members. Those of skill in the art will recognize that a variety of securing mechanisms 224 may be implemented to secure and/or adjust the telescoping members.

In addition, the inner wall 218 and the outer wall 220 of the telescoping vertical member 206 may vary in length, form, and number. In an alternative embodiment, rather than extending the length of the vertical member 206, the outer wall 220 may comprise a relatively short C-shaped channel 221 connected to the base 208. The channel 221 is configured to receive the inner wall 218. To secure the inner wall 218 to the outer wall 220, the outer wall 220 of the channel may include holes that align with tapped holes in the inner wall 218. A bolt may then be inserted through the holes to secure the telescoping vertical member 206.

The base 208, as mentioned, may have a variety of configurations. In certain embodiments, the base 208 may include feet 222. In another embodiment, the base 208 may include wheels to mobilize the support device 200. Although, in a preferred embodiment, the support device 200 rests on a sturdy structure, such as feet 222, when in use.

Figure 3:
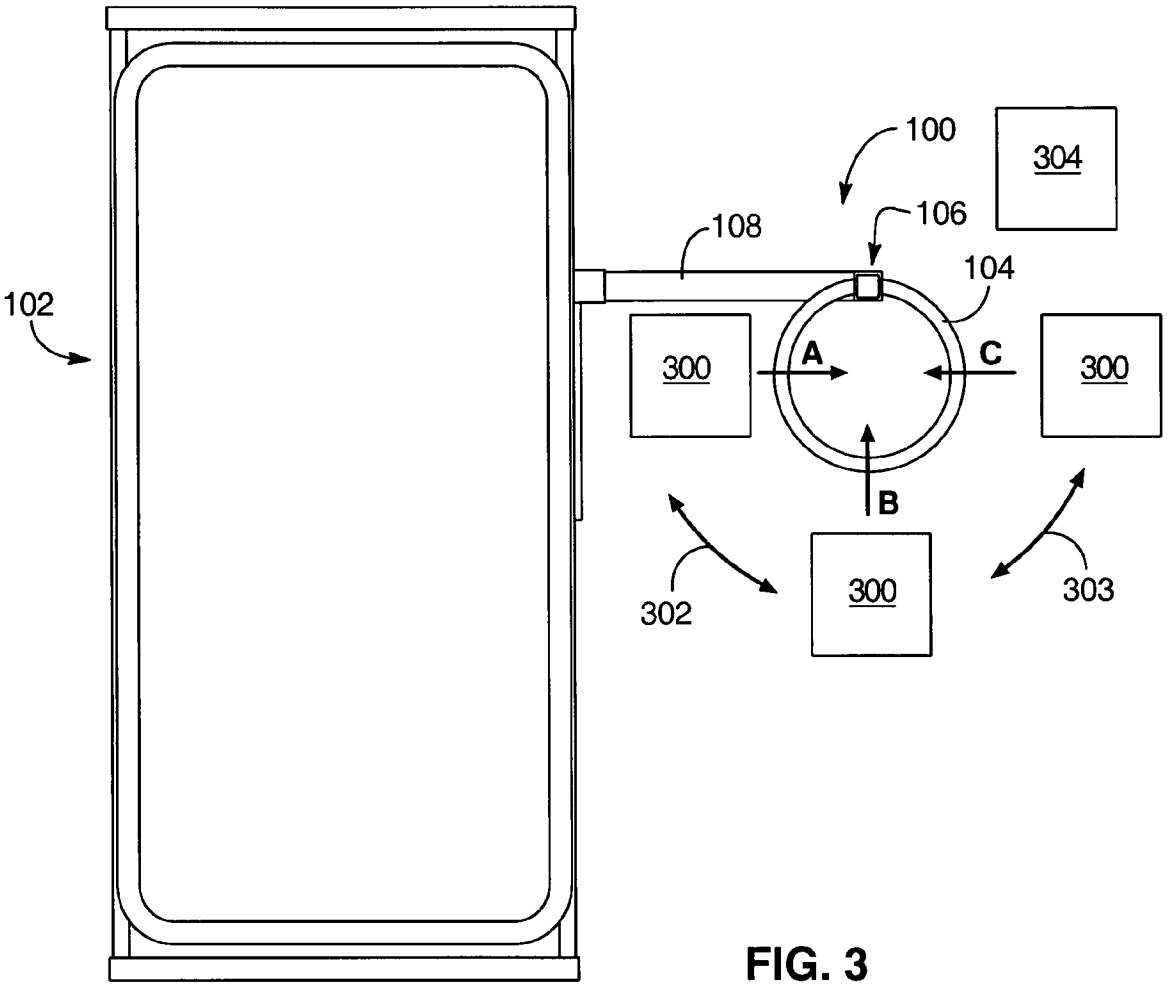
FIG. 3 is a plan view illustrating movement of a user around one embodiment of a support device in accordance with the present invention.

FIG. 3 is a plan view of one embodiment of a support device 100 used in conjunction with a bed 102. As illustrated, a vertical member 106 connected to a horizontal member 108 positions the handle 104 a distance away from the bed 102. Consequently, a user 300 may use the handle 104 for support to change positions or direction.

Suppose a user 300 is seated in a wheel chair facing direction B. First, the user 300 may use the handle 104 for support to rise to a standing position. Next, the user may slide 302 around the circumference of the handle 104 until they are positioned in the space between the bed 102 and the support device 100 facing direction A. The arcuate shape of the handle 104 allows the user 300 to slide one hand along the perimeter without releasing the grip. Then the user may use the support device 100 to sit safely on the bed 102.

As stated previously, the support device 100 supports the individual throughout the entire process without requiring the individual to release the handle 104. Alternatively, the user 300 may use the support device 100 to change from facing a first direction A by moving around the handle 104 to face a second direction B. If desired, the user 300 may proceed 303 around the handle 104 to face a third direction C. In certain instances, the user 300 may use the support device 100 to position themselves in a chair 304 (for example, when facing directions B or C) or to access a dresser or the like. Of course, the examples given are illustrative and do not limit the scope of the invention.

Figure 4:
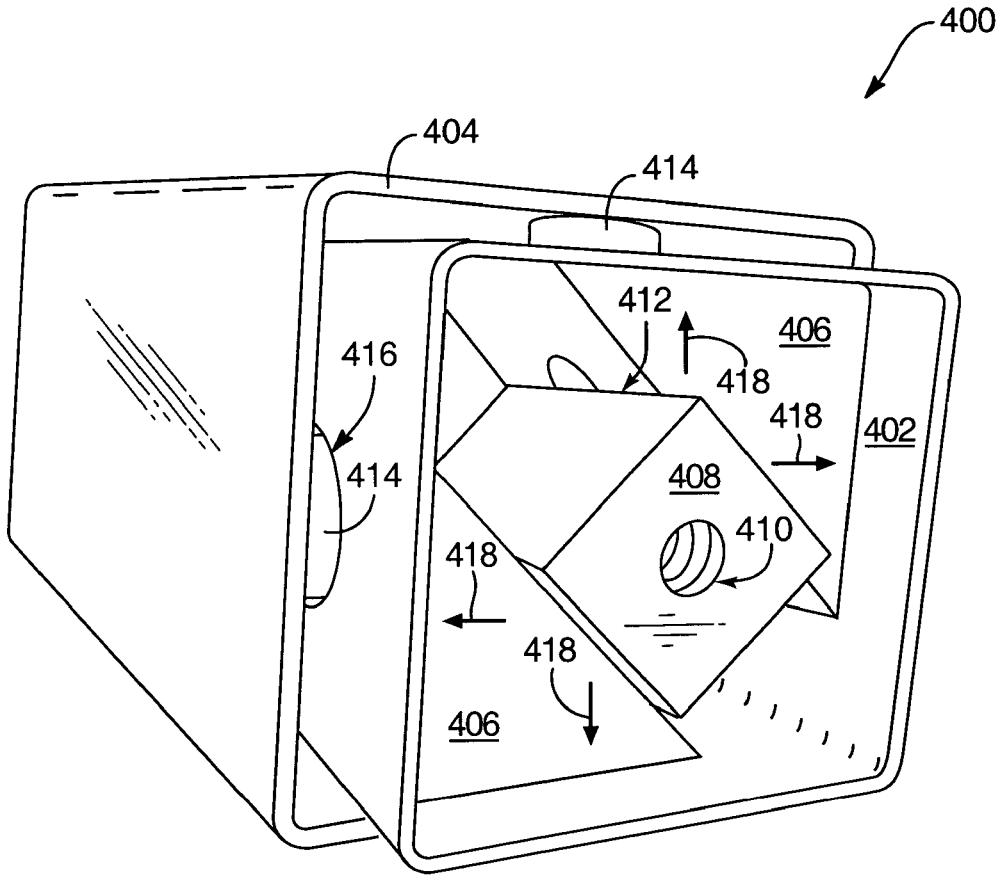
FIG. 4 is a perspective view of one embodiment of a securing mechanism in accordance with the present invention.

FIG. 4 illustrates one embodiment of a securing mechanism 400 for securing corresponding telescoping members within an apparatus. The securing mechanism 400 may be contained within a hollow inner wall 402 configured to be inserted into an outer wall 404. The walls 402, 404 may comprise hollow beams or tubes having a polygonal or circular cross section. The securing mechanism 400 may include a pair of stops 406, a center wedge 408, and studs 414. In one embodiment, the center wedge 408 may include a hole 410 with threads to engage a threaded shaft (not shown). A threaded shaft, which may be controlled by a hand knob, may then pull the center wedge 408 inward between the two stops 406 as the shaft is rotated. Tapered sides 412 of the wedge 408 permit the center wedge 408 to slide snugly between the two stops 406 like a wedge; thereby creating an outward force 418 that presses the stops 406 towards the outer wall 404. In one embodiment, this outward force 418 creates a friction fit connection between the inner wall 402 and the outer wall 404.

The inner wall 402, in one embodiment, may contain one or more openings 416 configured to receive studs 414 coupled to the stops 406. The studs 414 securely anchor the stops 406 relative to the inner wall 402 so that the center wedge 408 may slide into position without affecting the position of the stops 406 relative to the inner wall 402. As the center wedge 408 is pulled between the stops 406, an outward force 418 is created that pushes the studs 414 against the outer wall 404. When implemented in a support device 100, the inner wall 402 may comprise an inner wall 118 of a telescoping member 106, 114, and the outer wall 404 may comprise an outer wall 120 of a telescoping member 106, 114. The studs 414 pressing against the outer wall 120 form a securing mechanism 400 that prevents movement of the telescoping members 106, 114, thus creating a stable, secure support device 100. Consequently, an individual may confidently use the support device 100 without fear or reservation.

In one embodiment of the securing mechanism 400 may be placed within the telescoping members 106, 114 of the base 108 or vertical member 106 of the support device 100 to lock the adjusted position and to stabilize the support device 100. The securing mechanism 400 prevents the inner wall 402 from sliding or wobbling. Of course, the securing mechanism 400 may be incorporated into any other appropriate application.

Figure 5A:
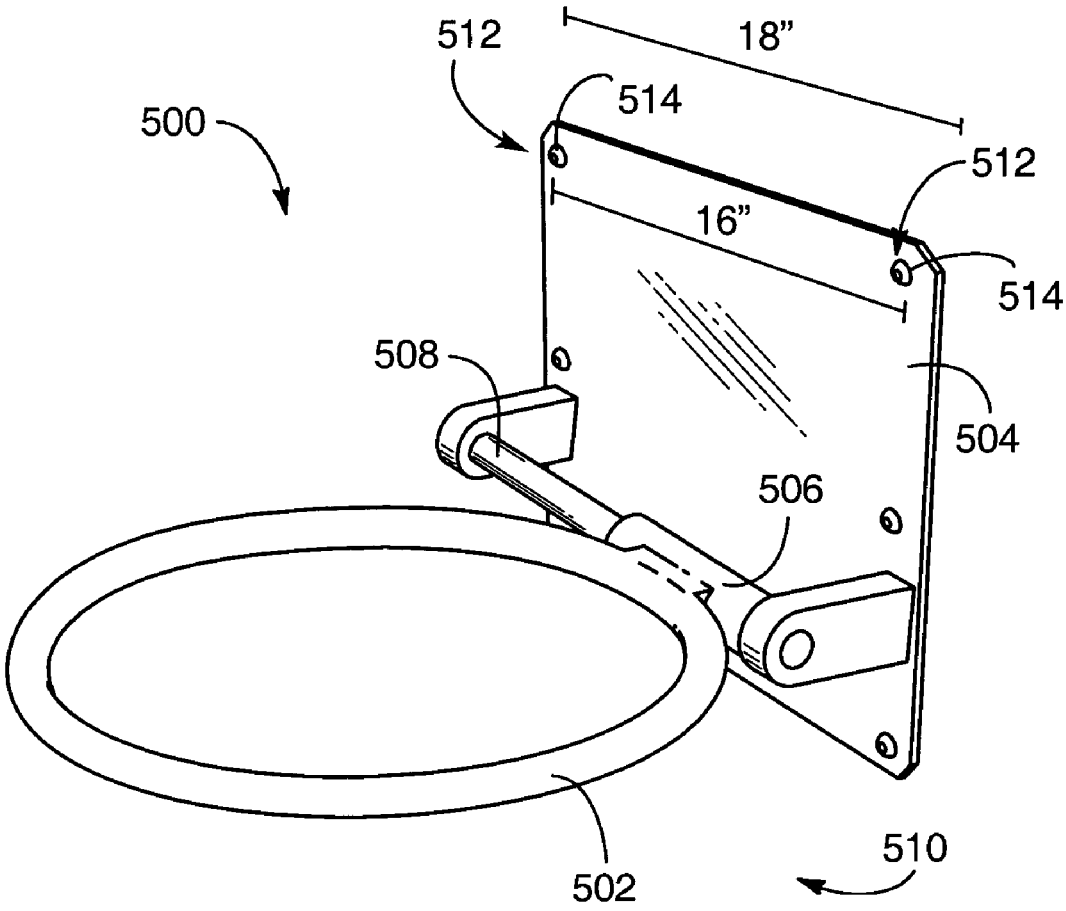
FIG. 5A is a perspective view of an alternative embodiment of a support device in a horizontal support position in accordance with the present invention.
Figure 5B:
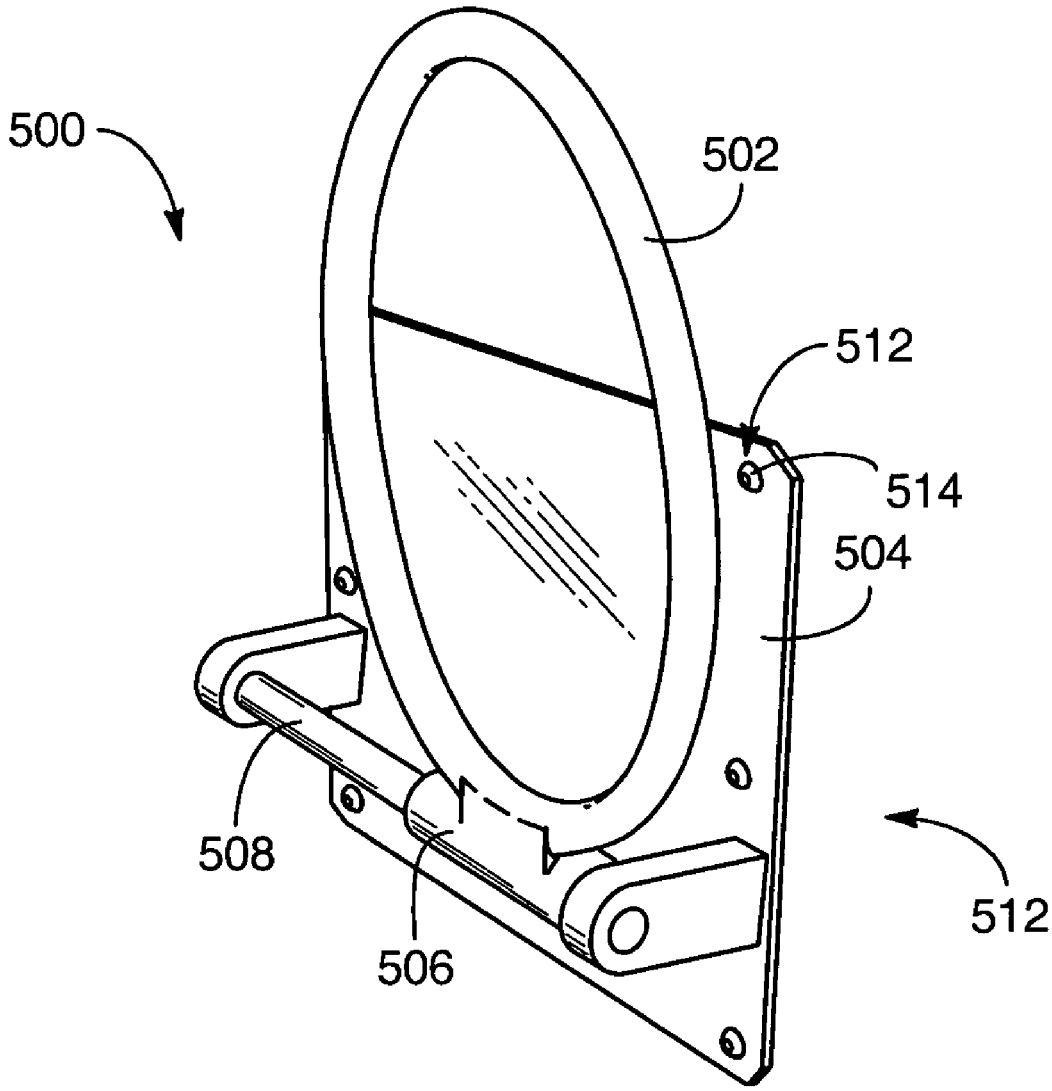
FIG. 5B is a perspective view of one embodiment of a support device in a vertical storage position in accordance with the present invention.

FIGS. 5A–5B illustrate an alternative embodiment of a support device 500. The support device 500 in the depicted embodiment includes a handle 502, a base 504, a hinge 506, and a bar 508. The handle 502 in FIG. 5A is shown in a horizontal support position 510. In the horizontal support position 510, the user can grasp the handle 502 for support to change from a first position to a second position. Similar to the support device 100, the support device 500 permits a user facing a first direction to traverse the perimeter of the handle to face a second direction. The handle 502 accordingly provides continual support such that the user may maintain grasp the handle 502 with at least one hand during the transition. Additionally, the user may lean against the handle 502 for support of the upper body if needed.

The base 504, in a preferred embodiment, is mounted to a sturdy support, such as a wall. The base 504 may be sufficiently wide to fasten the support device 500 to the studs of a wall. In one embodiment, the base is about eighteen inches by about thirteen inches and includes holes 512 to receive a plurality of fasteners, such as screws 514, to fasten the base 504 to the studs of a wall. The centers of the studs in a wall are typically spaced about sixteen inches apart. Preferably, a plurality of fasteners, or screws 514, are secured above the handle 502 to increase the stability of the support device 500. Thus, the multiple fasteners 514 reinforce the connection between the base 504 and the wall, or other support structure. A single fastener or fastening device to secure the support device 500 to a support structure, however, is also within the scope of the present invention. In one embodiment, the support device 500 is mounted at about waist level for the user.

The hinge 506 may attach the handle 502 to a bar 508 mounted to the base 504. The hinge 506 enables the user to store the handle 502 in a vertical position. FIG. 5B illustrates the handle 502 rotated to a vertical storage position 512. In one embodiment, the handle 502 rests against the wall or support in the vertical storage position 512. Consequently, the handle 502 may be stored in a compact area when not in use. Gravity preferably maintains the handle 502 against the wall, though latches or other securing devices may be used to secure the handle 502 in a vertical storage position 512.

The support device 500 may be particularly useful in a bathroom where space may be limited. The user may rotate the handle 502 from a vertical storage position 512 to a horizontal support position 510 to use the support device 500. Then, the user may grasp the handle 502 for support to stand from a wheel chair or the like, use the handle 502 for support to change directions, and then position themselves on a toilet or the like. As a result, the user may safely use the bathroom facilities without assistance. The support device 500 may then be used to transfer from the toilet back to the wheel chair. When the support device 500 is no longer needed, the user may return the handle 502 to a vertical storage position 512.

Figure 6:
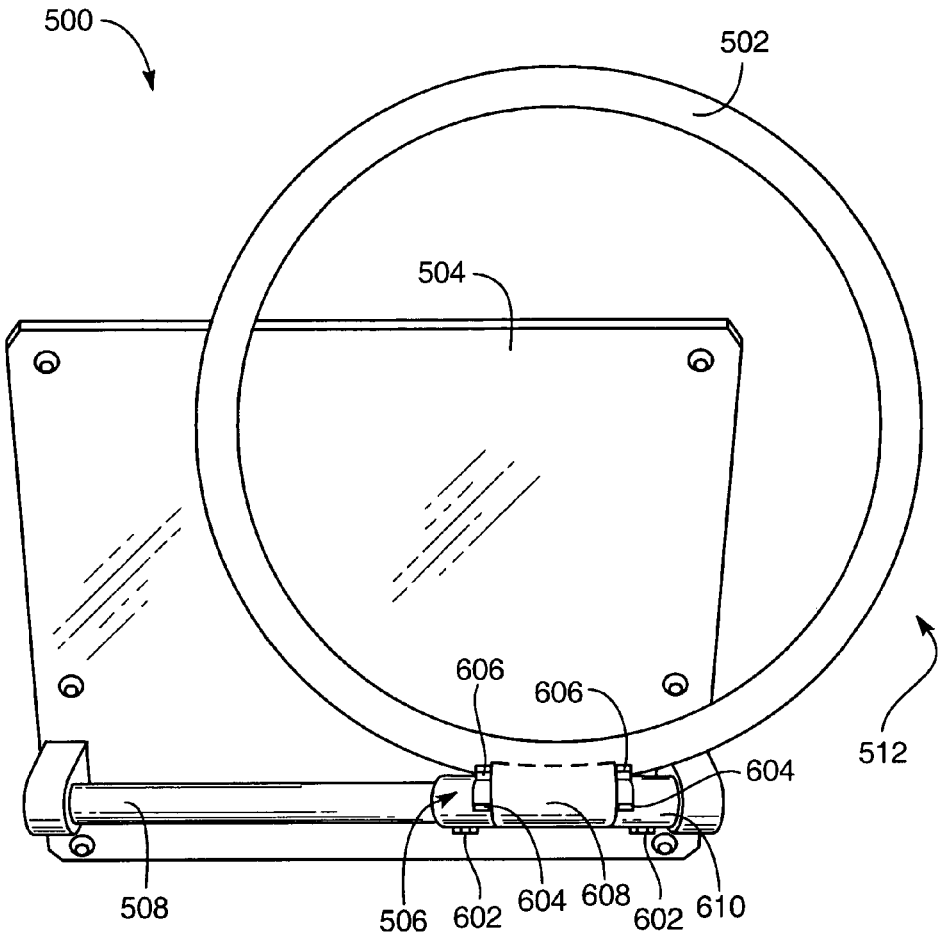
FIG. 6 is a front view of one embodiment of a support device in a vertical storage position in accordance with the present invention.

FIG. 6 illustrates a front view of one embodiment of a support device 500 in a vertical storage position 512. The support device 500 in the depicted embodiment illustrates in greater detail bolts 602, stops 604, and tabs 606 that may be used to secure the support device 500. The hinge 506 may include a rotating portion 608 and a stationary portion 610. The rotating portion 608 and the stationary portion 610 may comprise an outer and an inner tube respectively. Bolts 602, or other suitable fasteners, may secure the stationary portion 610 to the bar 508. Those of skill in the art will recognize that a variety of hinges, stops, and/or connectors may be used to couple the handle 502 to the base 504. As discussed, the handle 502, which is preferably connected to the hinge 506, pivots between a vertical storage position 512 and a horizontal support position 510.

In one embodiment, to secure the handle 502 in a horizontal support position 512, tabs 606, which may be screws inserted into the sides of a rotating portion 608 of the hinge 506, may catch on stops 604, which maybe notches in the stationary portion 610 of the hinge 506. Thus, the handle 502 rotates from a vertical storage position 510 until the tabs 606 catch on the stops 604. The stops 604 maintain the handle 502 in a substantially horizontal orientation relative to the floor.

Furthermore, the support device 500 may be adjusted to accommodate the user. The height of the handle 502, in one embodiment, may be selected as the support device 500 is installed. The user may choose where the support device will be mounted to a wall or the like. Alternatively, the support device 500 may further comprise apparatus to adjust the height of the handle 502. In certain embodiments, the vertical position of the handle 502 may also be adjusted.

The bar 508, in the depicted embodiment, enables the user to adjust the horizontal position of the handle 502. Once the base 504 is securely mounted to a support, the user may slide the handle 502 along the bar 508 to select a lateral position that best meets the needs of the user. For example, the support device 500 may be mounted to the studs in a wall across from a toilet at about waist level for the user. However, the studs may offset the position of the support device 500 relative to the toilet, which may be awkward or hard to reach for the user. Consequently, the user may need to adjust the position of the handle 502 to align the handle 502 with the toilet. The user may slide the handle 502, or hinge 506 in certain instances, to a desired position along the bar 508. Then the handle may be secured in the desired position for stability. In one embodiment, the hinge 506 of the handle 502 is secured to the bar 508 with bolts 602.

The support device 500 is preferably made from durable materials. In one embodiment, the base 504 is made from anodized aluminum, and the handle is made from a mild steel tubing. The handle 502, in one embodiment, is circular and has a sixteen inch outer diameter. The steel tubing has a diameter of about one inch.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for supporting an individual, the apparatus comprising:

a handle having an arcuate portion with an arc length configured to permit a user grasping the arcuate portion to slide one or two hands along the arcuate portion such that the user pivots about the center of the arcuate portion to face another direction while retaining grasp of the arcuate portion; a base coupled to the handle such that the base securely supports the handle and the user during movement around the arcuate portion; a hinge connecting the handle to the base, the hinge configured to enable the handle to rotate from substantially vertical storage positions to a substantially horizontal support position; and a bar mounted to the base and coupled to the handle, the bar configured to enable lateral slidable adjustable of the handle along the bar to desired selected positions.

2. The apparatus of claim 1, wherein the base comprise fasteners configured to mount the base to a wall.

3. The apparatus of claim 1, wherein the base is configured to mount to a sturdy support.

4. The apparatus of claim 1, wherein the handle, base, and hinge are configured to support a user leaning against the handle.

5. The apparatus of claim 1, wherein the arcuate portion is unobstructed.

6. The apparatus of claim 1, wherein the hinge comprises a rotating portion and a stationary portion, the stationary portion rotatably fixed in relation to the bar.

7. The apparatus of claim 6, wherein the rotating portion engages one or more stops of the stationary portion to restrict rotation of the rotating portion.

8. The apparatus of claim 7, wherein the stationary portion comprises at least one fastener configured to releasably engage the bar configured to enable sliding lateral adjustment of the handle along the bar.

9. The apparatus of claim 1, further comprising at least one fastener configured to retain the handle in the vertical storage position.

10. The apparatus of claim 1, wherein the handle comprises metal tubing having a diameter of about one inch.

11. The apparatus of claim 1, wherein the arcuate portion comprises a smooth curve devoid of corners.

12. The apparatus of claim 1, further comprising a cover configured to facilitated grasping of the handle.

13. The apparatus of claim 12, wherein the cover is configured to enhance a user's grip.

* * * * *